US010874898B1

(12) United States Patent
Torres

(10) Patent No.: US 10,874,898 B1
(45) Date of Patent: Dec. 29, 2020

(54) EXERCISE APPAREL WITH RESISTANCE BANDS

(71) Applicant: Renee T. Torres, Brooklyn, NY (US)

(72) Inventor: Renee T. Torres, Brooklyn, NY (US)

( * ) Notice: Subject to any disclaimer, the term of this patent is extended or adjusted under 35 U.S.C. 154(b) by 0 days.

(21) Appl. No.: 16/585,130

(22) Filed: Sep. 27, 2019

(51) Int. Cl.
*A63B 21/00* (2006.01)
*A63B 21/055* (2006.01)
*A41D 13/00* (2006.01)

(52) U.S. Cl.
CPC ..... *A63B 21/4025* (2015.10); *A63B 21/0552* (2013.01); *A41D 13/0015* (2013.01)

(58) Field of Classification Search
CPC ..... A63B 21/021–0552; A63B 21/4001–4025; A63B 5/11; A41D 13/0015
See application file for complete search history.

(56) References Cited

U.S. PATENT DOCUMENTS 5,186,701 A * 2/1993 Wilkinson ..... A63B 21/4021 482/125
5,203,754 A 4/1993 Maclean
5,306,222 A 4/1994 Wilkinson
5,308,305 A 5/1994 Romney
5,778,452 A * 7/1998 Dicker ..... A41D 13/0015 2/227
5,829,058 A 11/1998 Dicker et al.
5,842,959 A * 12/1998 Wilkinson ..... A41D 13/0015 482/121
5,857,947 A * 1/1999 Dicker ..... A63B 21/00185 2/69.5
5,978,966 A 11/1999 Dicker et al.
9,629,405 B2 4/2017 Cornish
9,737,097 B2 8/2017 Waldie et al.
10,118,063 B2 11/2018 DeYoung
10,195,475 B2 2/2019 Schreiber et al.
2011/0209264 A1* 9/2011 Williams ..... A41D 13/0015 2/69
2015/0342271 A1* 12/2015 Piccione ..... A41D 13/0015 2/69
2018/0200559 A1* 7/2018 Papashvili ..... A63B 21/00185
2019/0281902 A1* 9/2019 Nabors ..... A63B 21/065

* cited by examiner

*Primary Examiner* — Jennifer Robertson
(74) *Attorney, Agent, or Firm* — Cramer Patent & Design PLLC; Aaron R. Cramer

(57) ABSTRACT

Exercise apparel in the form of a top, a bottom or a combination thereof, incorporates at least one (1) resistance band. Each of the resistance bands is capable of removably securing within the apparel.

8 Claims, 4 Drawing Sheets

EXERCISE APPAREL WITH RESISTANCE BANDS

RELATED APPLICATIONS

Not applicable.

FIELD OF THE INVENTION

The present invention relates generally to exercise apparel and more specifically to exercise apparel having resistance bands.

BACKGROUND OF THE INVENTION

In physiology, medicine, and anatomy, muscle tone (residual muscle tension or tonus) is the continuous and passive partial contraction of the muscles, or the muscle's resistance to passive stretch during resting state. It helps to maintain posture and declines during REM sleep.

If a sudden pull or stretch occurs, the body responds by automatically increasing the muscle's tension, a reflex which helps guard against danger as well as helping maintain balance. Such near-continuous innervation can be thought of as a "default" or "steady state" condition for muscles. Both the extensor and flexor muscles are involved in the maintenance of a constant tone while at rest. In skeletal muscles, this helps maintain a normal posture.

Resting muscle tone varies along a bell-shaped curve. Low tone is perceived as "lax, flabby, floppy, mushy, dead weight" and high tone is perceived as "tight, light, strong". Muscles with high tone are not necessarily strong and muscles with low tone are not necessarily weak. In general, low tone does increase flexibility and decrease strength and high tone does decrease flexibility and increase strength, but with many exceptions. A person with low tone will most likely not be able to engage in "explosive" movement such as needed in a sprinter or high jumper. These athletes usually have high tone that is within normal limits. A person with high tone will usually not be flexible in activities such as dance and yoga. Joint laxity contributes greatly to flexibility, especially with flexibility in one or a few areas, instead of overall flexibility.

For example, a person can be high tone with normal to poor flexibility in most areas but be able to put the palms of the hands on the floor with straight knees due to hypermobile sacroiliac joints. It is important to assess several areas before deciding if a person has high, low or normal muscle tone. A fairly reliable assessment item is how the person feels when picked up. For example, small children with low tone can feel heavy while larger, high tone children feel light, which corresponds with the description of "dead weight".

Although cardiac muscle and smooth muscle are not directly connected to the skeleton, they also have tonus in the sense that although their contractions are not matched with those of antagonist muscles, the non-contractile state is characterized by (sometimes random) enervation.

Often times, those wishing to maintain body tone or are ordered to by the physician do not have the time or find the time to work out to regain or maintain muscle tone. Those people will often do the stretching and other exercises necessary and required if an easy, efficient method is provided that does not impede their desired activities and often time does not seem like a workout.

In light of the foregoing, there is a need for a device to provide a mechanism or method to provide proper muscle tone exercises without encroaching on the common activities of a person.

SUMMARY OF THE INVENTION

The principles of the present invention provide for a piece of active-body wear comprising an upper garment having a front, an interior, a first sleeve, and a second sleeve. The front of the upper garment has an opening closed by a closure. The interior of the upper garment has one or more upper garment retainers. The active-body wear also comprises a lower garment having a waist area, a first leg area with a first ankle area, and a second leg with a second ankle area and a first ankle retainer coupled to the first ankle area. The first ankle retainer is located substantially near a bottom of the first leg of the lower garment. The active-body wear also comprises a second ankle retainer which is coupled to the second ankle area. The second ankle retainer is located substantially near a bottom of the second leg of the lower garment. The active-body wear also comprises a first side first retainer which is vertically coaligned with a first side second retainer, each of which are coupled to an outer side of the first leg and a waist retainer which is coupled to the waist area of the lower garment. The active-body wear also comprises one or more resistance bands which removably may be coupled to the upper garment retainer of the interior of the upper garment. Each of the one or more resistance band has a first loop and a second loop, one of the loops is routed through and secured within the first ankle retainer.

The upper garment may be a garment selected from the group consisting of a hoody, a t-shirt, or a sweatshirt. The closure may be selected from the group consisting of a zipper, a Velcro fastener, one or more buttons, or one or more snaps. The front of the upper garment includes one or more pockets. The interior may be exposed when the opening of the front has the closure in an uncoupled configuration.

Each of the one or more upper garment retainers may have a shape that is selected from the group of is a cylindrical shape, a rectangular shape, or a square shape. The upper garment and the lower garment may be used together or utilized separately. The first ankle retainer and the second ankle retainer are each capable of removable attachment to the respective ankle area of the respective leg in a similar fashion as each upper garment retainer.

The first and second ankle retainers may be removably coupled to itself, so as to enable the user to remove the resistance band if desired. One of the resistance bands may be capable of being routed through both first side retainers. One of the resistance bands may also be capable of being routed through the waist retainer and the loops are capable of being grasped by the user.

The first loop of the resistance band may be configured to be a loop in shape, wherein a portion is doubled back on itself and securely affixed thereto, so as to produce the first loop. The first loop of the resistance band may further be configured to be securely coupled to or held by a first-hand of a user, thereby configured to be secured between a thumb and a first finger of the first hand of the user in at least one method of use. The second loop of the resistance band may be similarly sized and shaped as a loop as the first loop, to be further configured to be securely coupled to a second hand of a user, thereby configured to be secured between a thumb and a first finger of the second hand of the user.

The one or more resistance bands may be configured to enter the interior through a first sleeve opening of the first sleeve. The one or more resistance bands may also be configured to be routed through the second sleeve of the upper garment and exit through a second sleeve opening of the second sleeve of the upper garment. The resistance band may be made of a strong, stretch material, such that they are taut and when stretched will apply a tension to the elongation thereof. The resistance band, when no longer being stretched, returns to be taut.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
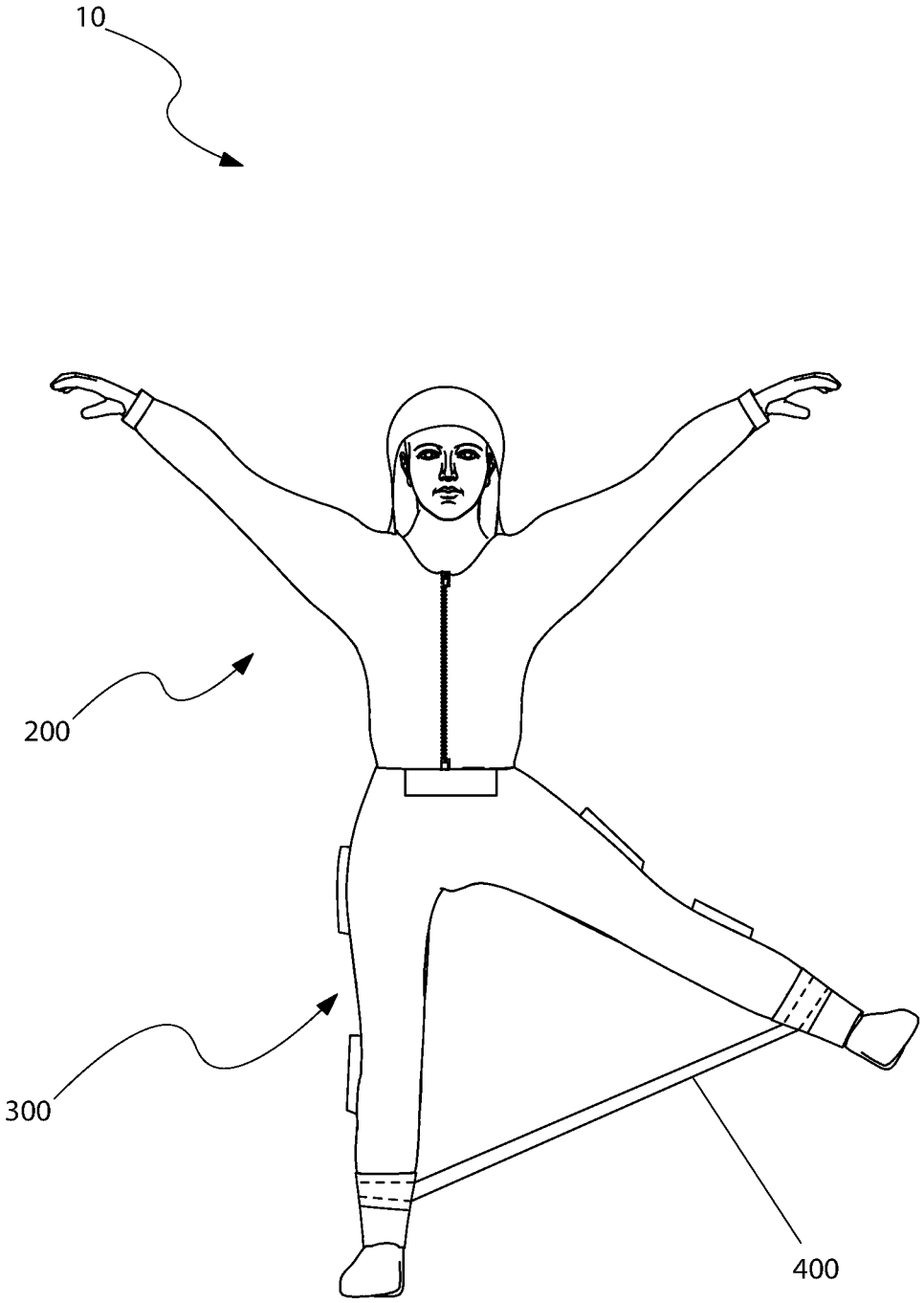
FIG. 1 is an illustrated view of an exemplary active body-wear 100.

100 active-body wear
200 upper garment
201 front
202 interior
203 first sleeve
204 second sleeve
206 closure
207 pocket
208 upper garment retainer
210 first sleeve opening
211 second sleeve opening
300 lower garment
301 waist area
302 first leg
303 second leg
305*a* first side first retainer
305*b* first side second retainer
306*a* second side first retainer
306*b* second side second retainer
309 waist retainer
400 resistance band
401 first loop
402 second loop
406 first ankle area
407 first ankle retainer
408 second ankle retainer
409 second ankle area

DESCRIPTION OF THE PREFERRED EMBODIMENTS

Figure 2:
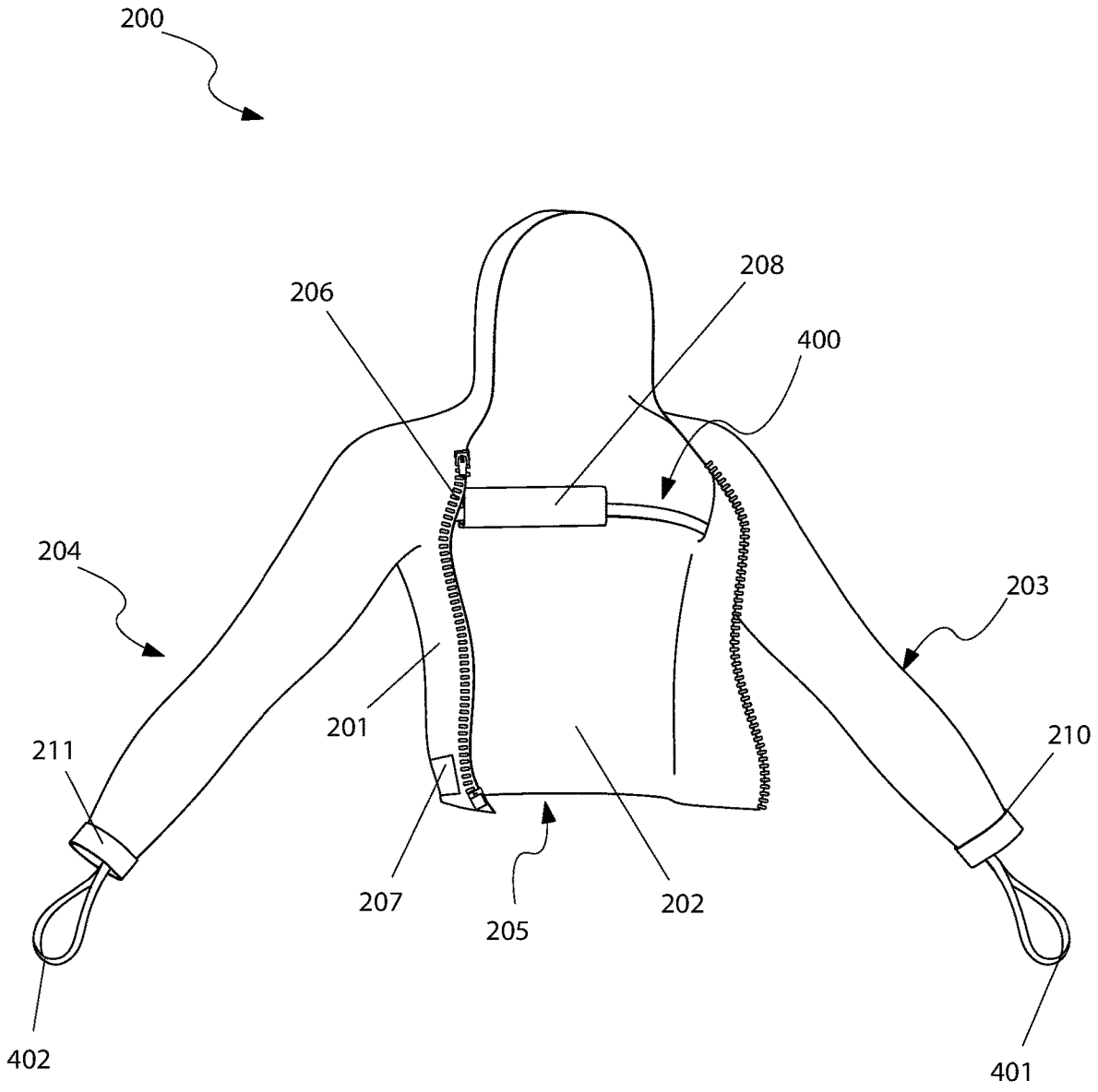
FIG. 2 is an illustrated view of an upper garment 200 of the exemplary active body-wear 100 as shown in FIG. 1.
Figure 3:
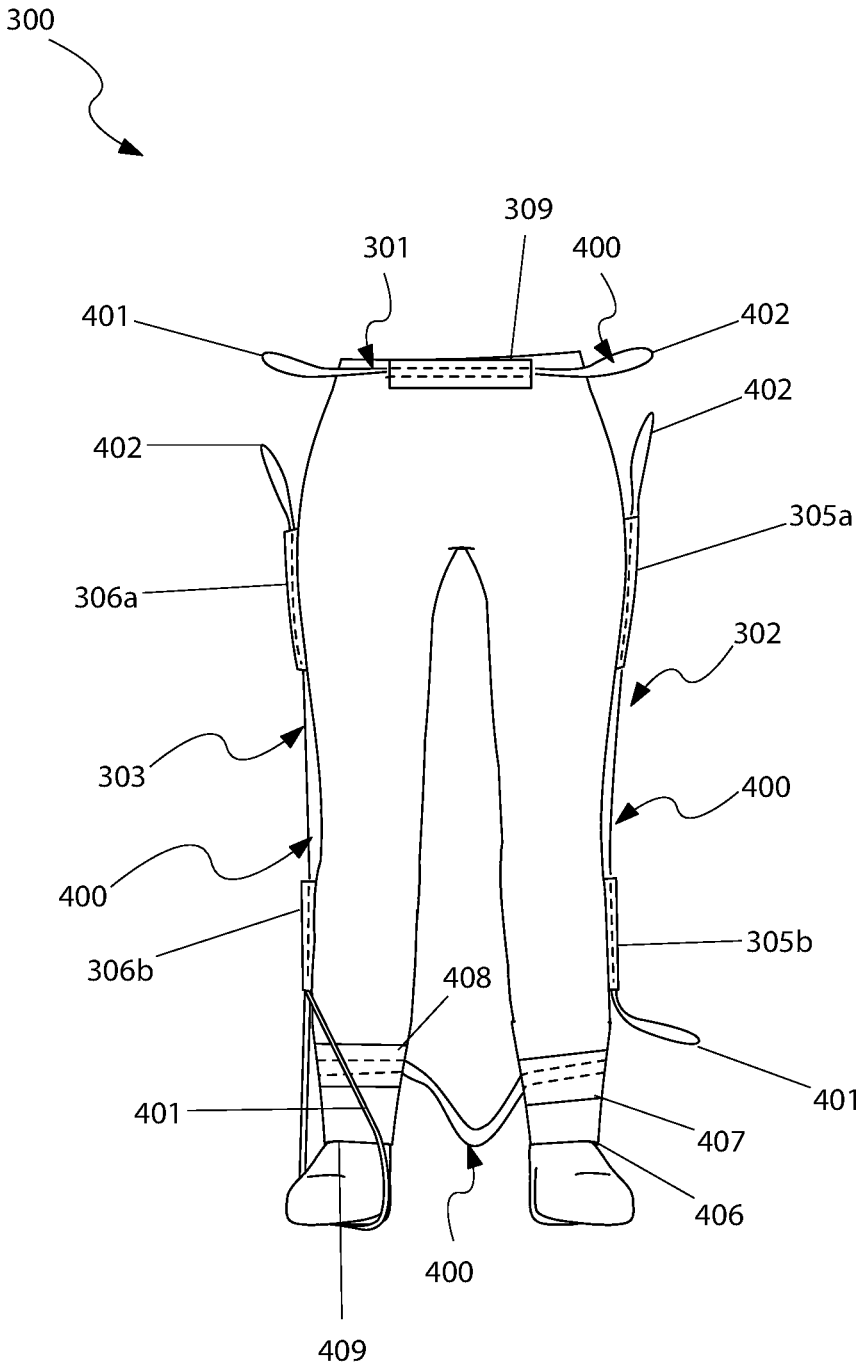
FIG. 3 is an illustrated view of an alternate version of a bottom garment 300 of the exemplary active body-wear shown in FIG. 1; and, FIG. 4 is an illustrated view of an alternate version of a bottom garment 300 of the exemplary active body-wear shown in FIG. 1.
Figure 4:
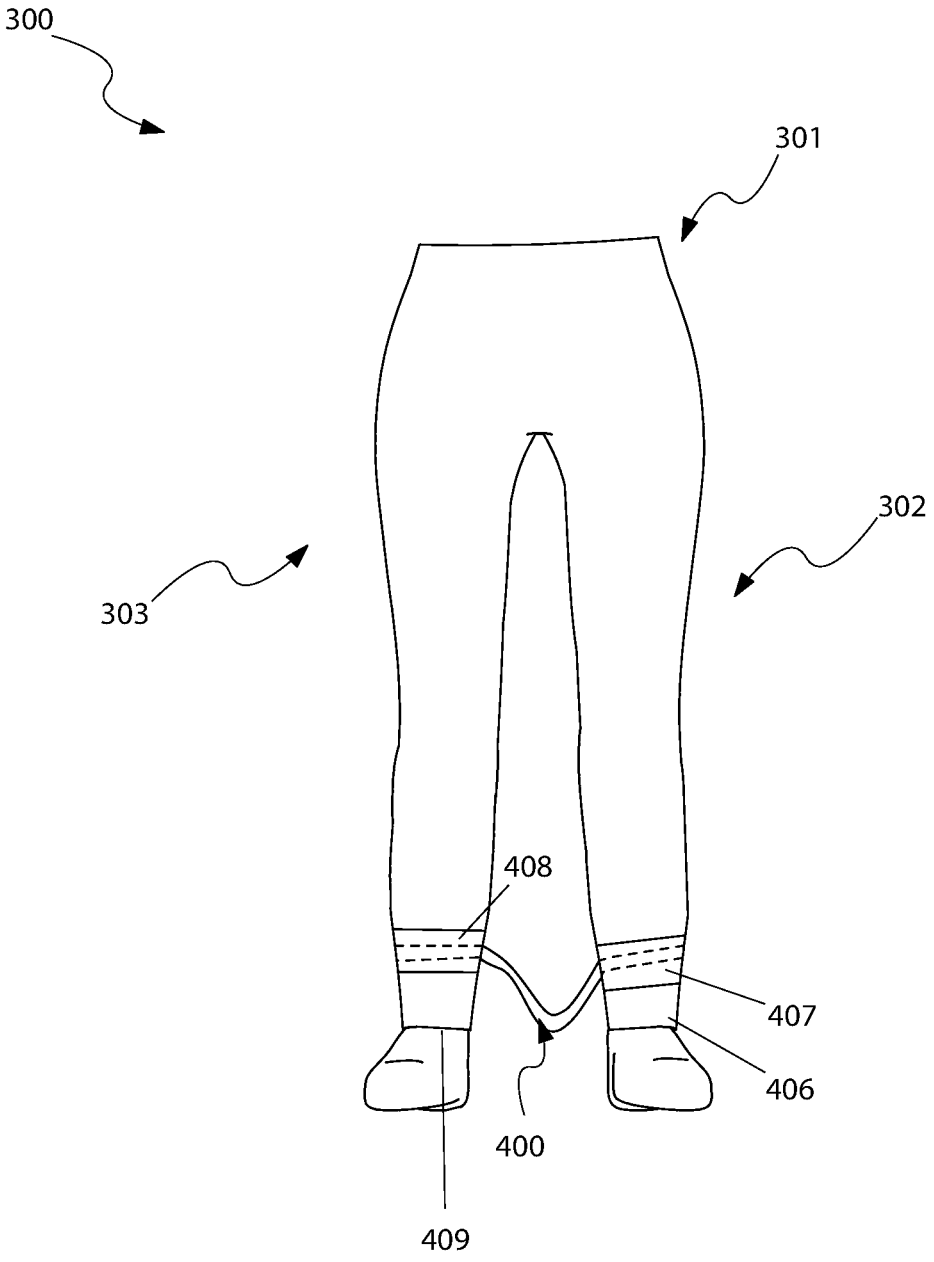

The best mode for carrying out the invention is presented in terms of its preferred embodiment, herein depicted within FIGS. 1 through 3 and in an alternate embodiment, within FIG. 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The phrases "in one (1) embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, is an illustrated view of an exemplary active body-wear 100 for working out while without having to seek a workout facility. The active body-wear 100 is useful for performing workout activities, such as squats, lunges, gymnastics and ballet for all forms of upper and lower body workouts. The active-body wear 100 provides a built-in gym into normal gym clothing.

The active-body wear 100 has an upper garment 200, a lower garment 300 and one (1) or more resistance bands 400. The upper garment 200 and lower garment 300 can be used together or separately.

FIG. 2 is an illustrated view of the upper garment 200 of the active-body wear 100. The upper garment 200 has a front 201, an interior 202, a first sleeve 203, and a second sleeve 204. The upper garment 200 of the active-body wear 100 is preferably a hoody, but other types of upper garments 200 are hereby contemplated, including, but not limited to: a t-shirt, a sweatshirt, etc.

The front 201 of the upper garment 200 has an opening 205. The opening 205 can be closed by a closure 206. The closure 206 is preferably a zipper closure; however other closures 206 are hereby contemplated, including, but not limited to: Velcro™, buttons, snaps, etc. The front 201 of the upper garment 200 further may optionally have one (1) or more pockets 207.

The interior 202 is exposed when the opening 206 of the front 201 has the closure 206 in an uncoupled configuration. The interior 202 of the upper garment 200 has one (1) or more upper garment retainers 208 (ostensibly located in a central portion and oriented horizontally). Each of the upper garment retainers 208 is preferably cylindrical shape, however other shapes are hereby contemplated, including, but not limited to: rectangular, square, etc. Each upper garment retainer 208 is coupled to the interior 202 of the workout wear 100. Similar to the closure 206, each upper garment retainer 208 is fastened to itself or the interior 202 via Velcro™, buttons, snaps, etc.

One (1) of the resistance bands 400 is removably coupled to the upper garment retainer 208 of the interior 202 of the upper garment 200. The resistance band 400 is configured to enter the interior 202 through a first sleeve opening 210 of the first sleeve 203. The resistance band 400 is configured to be inserted through the one (1) or more upper garment retainers 208. The resistance band 400 is configured to be routed through the second sleeve 204 of the upper garment 200 and exit through a second sleeve opening 211 of the second sleeve 204 of the upper garment 200.

Each resistance band 400 has a first loop 401 and a second loop 402. The first loop 401 of the resistance band 400 is configured to be a loop in shape, wherein a portion is doubled back on itself and securely affixed thereto, so as to produce a loop of some cross-sectional area. The cross-sectional area of the first loop 401 of the resistance band 400 is further configured to be securely coupled to or held by a first hand of a user, thereby configured to be secured between a thumb and first finger of the first hand of the user in at least one (1) method of use.

The second loop 402 of the resistance band 400 is similarly sized and shaped as a loop as the first loop 401, to be further configured to be securely coupled to a second hand of a user, thereby configured to be secured between a thumb and first finger of the second hand of the user. The resistance band 400 is preferably made of a strong, stretch material, such that they are taut and when stretched will apply a tension to the elongation thereof. The resistance band 400, when no longer being stretched, returns to be taut.

Moving to FIG. 3, the lower garment 300 of the active-body wear 100 is presented. The lower garment 300 is preferably fashioned as sweat pants, but other types of pants are hereby contemplated, including, but not limited to: yoga pants, compression wear, etc.

The lower garment 300 of the active-body wear 100 has a waist area 301, a first leg 302 with a first ankle area 406, and a second leg 303 with a second ankle area 409. A first ankle retainer 407 is coupled to the first ankle area 406, located substantially near a bottom of the first leg 302 of the lower garment 300. One (1) of the loops 401, 402 of a single resistance band 400 is routed through and/or secured within the first ankle retainer 407. A second ankle retainer is coupled to the second ankle area 409, located substantially near a bottom of the second leg 303 of the lower garment 300. The first ankle retainer 407 and second ankle retainer 408 are each capable of removable attachment to the respective ankle area 406, 409 of the respective leg 301, 302, in a similar fashion as each upper garment retainer 208. Further, each of the first and second ankle retainers 407, 408 can be removably coupled to itself, so as to enable the user to remove the resistance band 400 if desired.

A first side first retainer 305*a* (ostensibly located near the waist area 301) is vertically coaligned with a first side second retainer 305*b* (ostensibly located adjacent the first ankle area 406), each of which are coupled to an outer side of the first leg 302, similar in fashion to the upper garment retainer 208. A resistance band 400 is capable of being routed through both first side retainers 305*a*, 305*b*. Similarly, a second side first retainer 306*a* (ostensibly located near the waist area 301) is vertically coaligned with a second side second retainer 306*b* (ostensibly located adjacent the second ankle area 409), each of which are coupled to an outer side of the second leg 303, similar in fashion to the upper garment retainer 208. A resistance band 400 is capable of being routed through both first side retainers 306*a*, 306*b*. One (1) of the loops 401, 402 is capable of being looped around a foot and a second one (1) of the loops 401, 402 can be grasped by the user on either side of the lower garment 300.

A waist retainer 309 (ostensibly located on a central front portion of the waist area 301) is coupled to the waist area 301, similar in fashion to the upper garment retainer 208. A resistance band 400 is capable of being routed through the waist retainer 309. The loops 401, 402 are capable of being grasped by the user.

In alternate embodiments, the resistance bands 400 may be positioned in any desirable position of the first leg 302 and second leg 303 of the lower garment 300. The different desired positions may allow for an increase or decrease, as determined by positioning of the resistance bands 400, to increase or decrease the impact of the workout. Further, the different positioning of the resistance bands 400 affords the ability to workout different muscle groups. In other embodiments, only the ankle retainers 407, 408 are present in the lower garment 300. Such an alternate embodiment is that illustrated in FIG. 4. In other alternate embodiments, the ankle retainers 407,408 can be removably attached to other support structures, such as that worn by the user (e.g., footwear).

In the numbered clauses below, specific combinations of aspects and embodiments are articulated in a shorthand form such that, according to respective embodiments, for each instance in which a "component" or other such identifiers appear to be introduced (with "a" or "an," e.g.) more than once in a given chain of clauses, such designations may either identify the same entity or distinct entities; and, what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one (1) embodiment may be applied to other embodiments or combined with or interchanged with the features of other embodiments, as appropriate, without departing from the scope of the present invention.

The invention claimed is:

1. A piece of active-body wear configured to be worn by a user, comprising:

an upper garment having a front, an interior, a first sleeve, and a second sleeve, the front of the upper garment has an opening closed by a closure, the interior of the upper garment has one or more upper garment retainers;

a lower garment having a waist area, a first leg area with a first ankle area, and a second leg with a second ankle area;

a first ankle retainer coupled to the first ankle area, the first ankle retainer located substantially near a bottom of the first leg of the lower garment;

a second ankle retainer coupled to the second ankle area, the second ankle retainer located substantially near a bottom of the second leg of the lower garment;

a first side first retainer vertically coaligned with a first side second retainer, each of which are coupled to an outer side of the first leg;

a waist retainer coupled to the waist area of the lower garment; and one or more resistance bands removably coupled to the upper garment retainer of the interior of the upper garment, each of the one or more resistance band has a first loop and a second loop, one of the loops is routed through and secured within the upper garment retainer;

wherein the closure is selected from the group consisting of a Velcro fastener, one or more buttons, or one or more snaps;

wherein each of the one or more upper garment retainers has a square shape;

wherein one of the resistance bands is routed through both first side retainers;

wherein one of the resistance bands is routed through the waist retainer and the loops are configured to be grasped by the user;

wherein the upper garment is a garment selected from the group consisting of a hoody or a sweatshirt;

wherein the first ankle retainer and the second ankle retainer of one of the one or more resistance bands are each configured to be movably attached to the respective ankle area of the respective leg of the user;

wherein the first loop of the resistance band is a loop in shape, wherein a portion is doubled back on itself and securely affixed thereto, so as to produce the first loop;

wherein the first loop of the resistance band securely configured to be coupled to or held by a first-hand of the user, thereby configured to be secured between a thumb and a first finger of the first hand of the user;

wherein the second loop of the resistance band securely configured to be coupled to or held by a second-hand of the user, thereby configured to be secured between a thumb and a first finger of the second hand of the user;

wherein the one or more resistance bands enter the interior through a first sleeve opening of the first sleeve; and wherein the one or more resistance bands is routed through the second sleeve of the upper garment and exit through a second sleeve opening of the second sleeve of the upper garment.

2. The piece of active-body wear, according to claim 1, wherein the front of the upper garment includes one or more pockets.

3. The piece of active-body wear, according to claim 1, wherein the interior is exposed when the opening of the front has the closure in an uncoupled configuration.

4. The piece of active-body wear, according to claim 1, wherein the upper garment and the lower garment are used together.

5. The piece of active-body wear, according to claim 1, wherein the upper garment and the lower garment are separate.

6. The piece of active-body wear, according to claim 1, wherein the first and second ankle retainers are configured to be removably coupled to itself, so as to enable the user to remove the resistance band.

7. The piece of active-body wear, according to claim 1, wherein the resistance band is made of a strong, stretch material, such that they are taut and when stretched will apply a tension to the elongation thereof.

8. The piece of active-body wear, according to claim 7, wherein the resistance band, when no longer being stretched, returns to be taut.

* * * * *